US006196088B1

(12) United States Patent
Youngren

(10) Patent No.: US 6,196,088 B1
(45) **Date of Patent: *Mar. 6, 2001**

(54) HAMMER WITH STRIKING CAP

(75) Inventor: Robert Harold Youngren, Rockford, IL (US)

(73) Assignee: Estwing Manufacturing Company, Rockford, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/027,434

(22) Filed: Feb. 20, 1998

(51) Int. Cl.[7] ..... B25D 1/00; B25G 1/00
(52) U.S. Cl. ..... 81/26; 7/143; 81/20; 81/492
(58) Field of Search ..... 81/20, 26, 492; 7/143, 146, 147; 16/422

(56) References Cited

U.S. PATENT DOCUMENTS

| | | | | |
|---|---|---|---|---|
| 298,649 | | 5/1884 | Yingling et al. | 81/26 |
| 298,650 | | 5/1884 | Yingling et al. . | |
| 1,221,655 | * | 4/1917 | Benison . | |
| 1,304,647 | | 5/1919 | Basta . | |
| 1,518,259 | * | 12/1924 | Filiatreault . | |
| 1,717,562 | | 6/1929 | Howard . | |
| 2,960,133 | | 11/1960 | Shepherd | 145/61 |
| 4,660,832 | | 4/1987 | Shomo | 273/73 |
| 4,831,901 | | 5/1989 | Kinne | 81/25 |
| 5,211,085 | | 5/1993 | Liou | 81/20 |
| 5,490,437 | | 2/1996 | Hebert et al. | 81/22 |

* cited by examiner

*Primary Examiner*—Timothy V. Eley
(74) *Attorney, Agent, or Firm*—Gardner Carton & Douglas

(57) ABSTRACT

The novel hammer of the invention is a hammer having a reinforced handle, wherein the handle includes a grip and an integrally attached striking cap at least partially embedded in the grip. The striking cap is of a material harder than the grip, and provides the hammer with a striking surface at the butt end of the handle. The striking cap may further have at least one rib or groove, which serve to more strongly affix the striking cap to the hammer. The invention also includes a reinforced grip, and a method of manufacture of the hammer of the invention.

7 Claims, 3 Drawing Sheets

HAMMER WITH STRIKING CAP

FIELD OF THE INVENTION

The invention relates to hammers and in particular to a means for reinforcing, and providing a striking surface on, the butt end of the hammer.

SCOPE OF THE PRIOR ART

It is not uncommon for craftspeople such as carpenters or bricklayers to use the butt end of a hammer for certain applications, such as to tap bricks into alignment in mortar when bricklaying. This tapping deforms and damages the hammer handle so as to lessen the utility of the hammer as well as the comfort of the handle.

Although hammers and hammer handles are known in the art, there is a need for a hammer with a grip and an integrally attached striking cap, which provides a striking surface which is harder than the grip material. It is the integral attachment of the striking cap to the hammer which imparts an improved durability to the hammer handle as compared to the prior art hammer handles, and which provides an improved striking surface to the hammer as compared to prior art hammers where the handles are constructed entirely of grip material.

SUMMARY OF THE INVENTION

It is therefore an object of the present invention to provide a novel reinforced hammer wherein the butt end of the hammer is at least partly protected from striking damage while providing a resilient striking surface.

It is a further object of the invention to provide a novel hammer handle having a harder surface on the butt end than that provided by the grip material.

It is a further object of the invention to provide a method for making the novel hammer of the invention.

Other objects and advantages of the present invention will become obvious to the reader and it is intended that these objects and advantages are within the scope of the present invention.

The novel hammer of the invention is a hammer having a reinforced handle, wherein the handle includes a grip and an integrally attached striking cap at least partially embedded in the grip. The striking cap is of a material harder than the grip, and provides the hammer with a striking surface at the butt end of the handle. The striking cap may farther have at least one rib or groove, which serve to more strongly affix the striking cap to the hammer. The invention also includes a reinforced grip, and a method of manufacture of the hammer of the invention.

DETAILED DESCRIPTION OF THE PREFERRED EMBODIMENT

Figure 1:
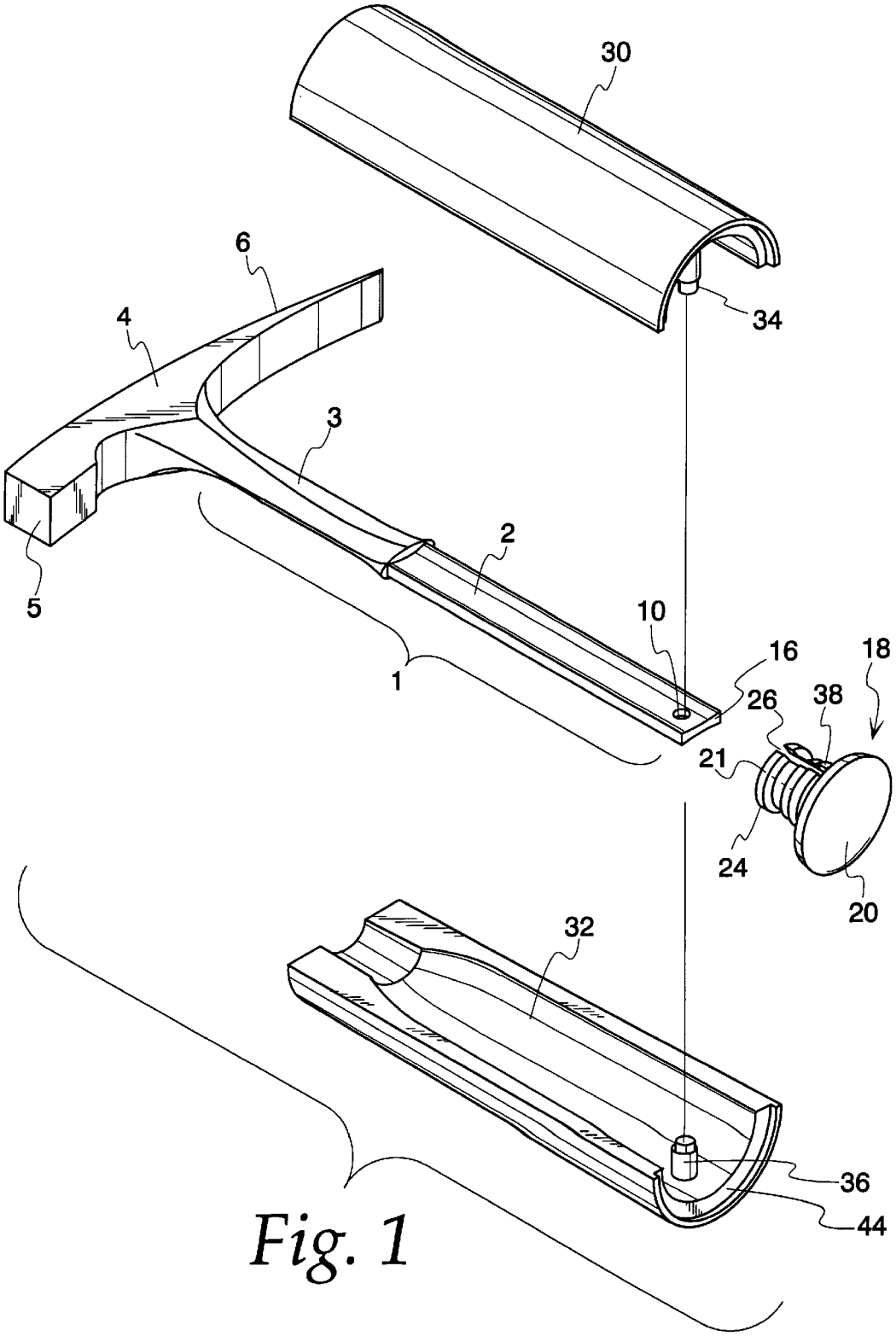
FIG. 1 is an exploded view of a hammer and manufacturing mold for a reinforced grip constructed in accordance with the present invention.
Figure 2:
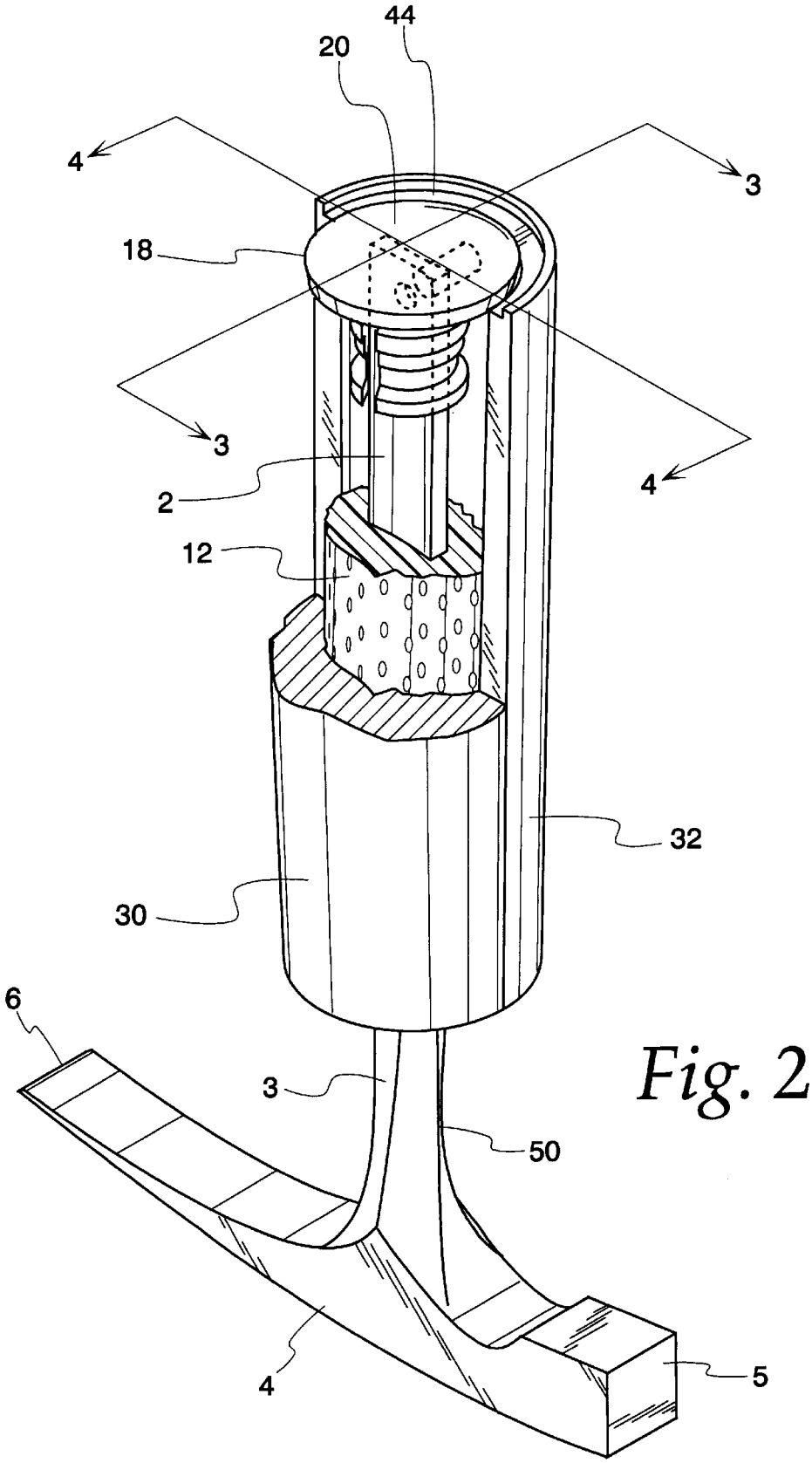
FIG. 2 is a cut-away view of a hammer of the present invention, showing placement of the striking cap of the invention.
Figure 3:
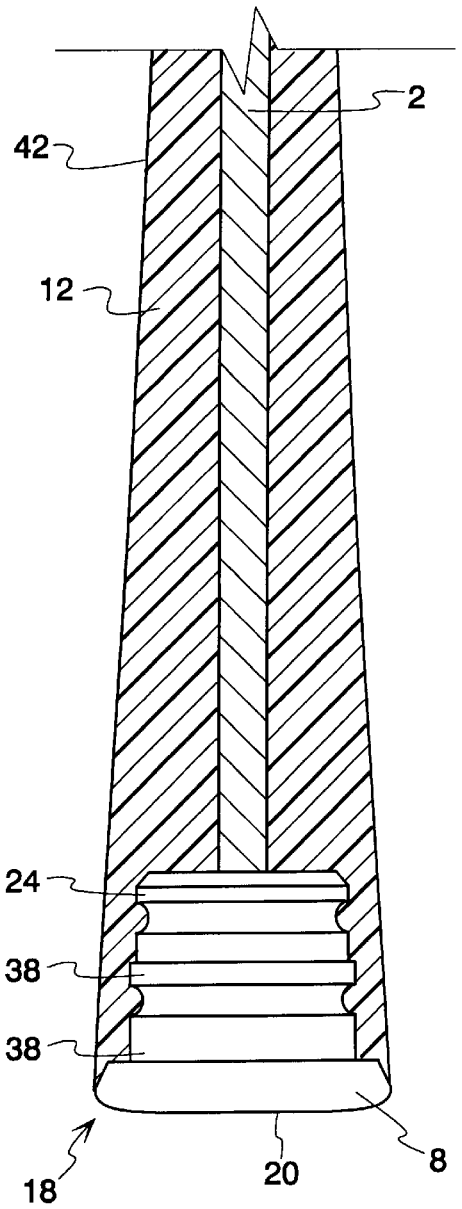
FIG. 3 is a cross-sectional longitudinal view of a hammer of the invention through the plane of 4—4 of FIG. 2, showing placement of an integrally molded striking cap in accordance with a hammer of the invention.
Figure 4:
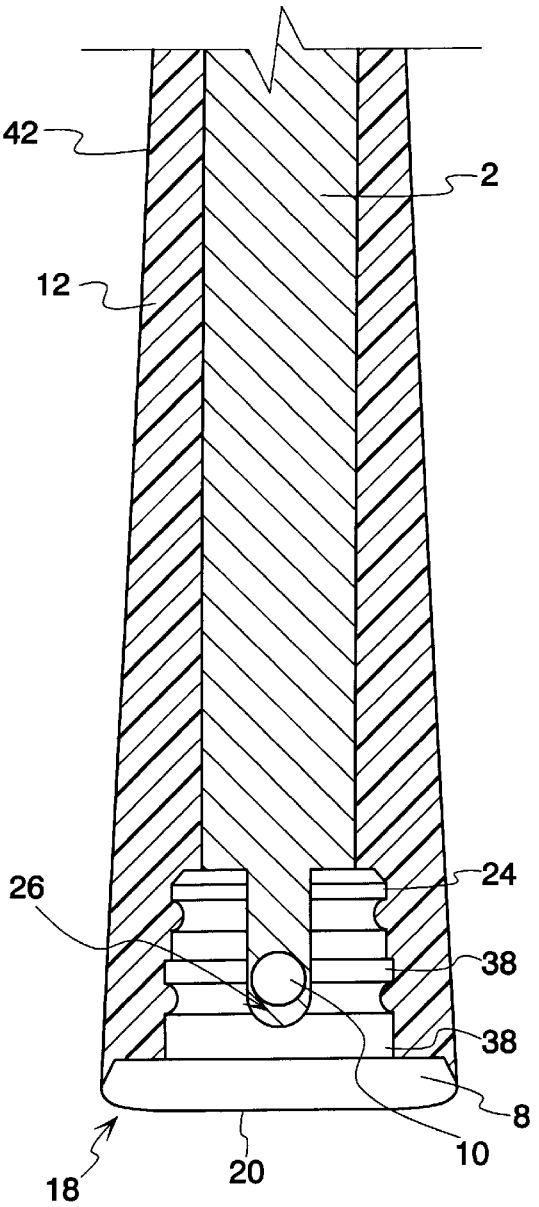
FIG. 4 is a cross-sectional longitudinal side view of a hammer of the invention through the plane of 5—5 of FIG. 2, showing placement of an integrally molded striking cap in accordance with a hammer of the invention.

FIGS. 1–4 illustrate a hammer 50 made in accordance with the present invention having head 4, and a handle 1. The head 4 includes a claw end 6 and an opposing striking end 5, which claw end may be configured according to any prior art hammer head such as with a chisel, or ball, or forked claw. The handle includes a handle neck 3, a shank 2, and a reinforced grip 42. The shank 2 may have an opening 10 near the butt end 16, through which the hammer may be hung on hooks or other like devices. The reinforced grip 42 of the invention has a grip 12 and striking cap 18, which striking cap is integrally attached to grip 12. The grip 12 covers shank 2.

The striking cap 18 of the hammer 50 and the reinforced grip 42 of the invention has a shank end 24, a striking surface 20 and a cavity 21. At least one rib or groove 38 may be present on the striking cap 18, which rib or groove is surrounded by the grip 12, and strengthens the integral attachment of striking cap 18 to the grip 42 and hammer 50.

In other preferred embodiments of the hammer and the reinforced grip of the invention having an opening 10, the striking cap 18 may further include at least two opposing u-shaped notches 26 extending vertically from the shank end 24 to a point above the striking surface 20. The notches 26, if included, allow the striking cap 18 to be inserted into a handle mold 30, 32 such as the one illustrated in FIG. 1 around the lower studs 34 and 36, thus properly positioning the striking cap 18 to preserve opening 10 during manufacture of the reinforced grip 42.

In a preferred embodiment of the method of the invention, the mold halves 30 and 32 are assembled around the shank 2. Grip material is then added to the assembled mold, illustrated here as added through the open mold collar 44, although the grip material may also be added by injection molding as described below, according to any prior art injection molding methods. Before the grip material is cured, the striking cap 18 is inserted into the mold and the butt end 16 of the shank is inserted into the cavity 21 of the striking cap 18. Grip material fills all spaces within the assembled handle mold. Once cured, striking cap 18 is integrally embedded within reinforced grip 12 such that striking surface 20 is exposed and forms the butt end 8 of a hammer 50 constructed in accordance with the principles of the invention.

In another preferred embodiment of the method of the invention, injection molding, shank 2 is inserted into a handle mold containing injection ports. The striking cap 18 is positioned within the mold such that the striking surface 20 will form the butt end of the hammer, and the butt end 16 of the shank is inserted into cavity 21 of the striking cap 18. Properly inserted, striking surface 20 is positioned such that the handle does not cover the striking surface 20. Grip material is injected into the mold through the injection ports so that the grip material fills all spaces within the mold. Once cured, striking cap 18 is integrally embedded within grip 12 such that striking surface 20 is exposed and forms the reinforcing butt end 8 of a hammer 50 constructed by injection molding in accordance with the principles of the invention.

In the preferred embodiments, the grip material is composed of a polymer and vinyl composite which is sufficiently resilient to absorb at least part of the striking force of the hammer, although any curable material suitable for use as a hammer grip may be used in the present invention. The striking cap of the invention may be made of any material which is harder than the grip material and sufficiently hard to better withstand striking blows than the grip material.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be within the scope of the claims.

I claim:

1. A hammer having a reinforced grip end, the hammer comprising:

a head;

a handle neck extending from the head;

a shank extending from the handle neck;

an integrally formed handle positioned at the grip end, the handle having a hardened grip at least partly surrounding the shank, wherein the hardened grip is formed from a curable liquid grip material and a striking cap including notches for gripping the curable liquid integrally embedded within the grip at a butt end of the handle, wherein the handle is formed by inserting at least a portion of the striking cap, including the notches, into the curable liquid grip material and curing the grip material thereby affixing the striking cap and the notches within the hardened grip to embed the striking cap within the handle, and wherein a portion of the striking cap within the grip is entirely surrounded by grip material.

2. The hammer of claim 1 wherein the striking cap comprises at least two notches.

3. The hammer of claim 1, wherein the grip at least partly surrounds the striking cap, and wherein the striking cap is of harder material than the grip.

4. The hammer of claim 2, wherein the handle further comprises an opening.

5. The hammer of claim 3, wherein the striking cap further comprises at least one rib.

6. The hammer of claim 3, wherein the striking cap further comprises at least one groove.

7. The hammer of claim 3, wherein the striking cap further comprises a striking surface.

* * * * *